US007999212B1

(12) United States Patent
Thiesen et al.

(10) Patent No.: US 7,999,212 B1
(45) Date of Patent: Aug. 16, 2011

(54) PRECISION GUIDED MUNITIONS

(75) Inventors: Jack H. Thiesen, Plymouth, MI (US); Karl F. Brakora, Dexter, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 215 days.

(21) Appl. No.: 12/434,453

(22) Filed: May 1, 2009

Related U.S. Application Data

(60) Provisional application No. 61/049,601, filed on May 1, 2008, provisional application No. 61/058,097, filed on Jun. 2, 2008.

(51) Int. Cl.
*F41G 7/28* (2006.01)
*F41G 7/30* (2006.01)
*F41G 7/00* (2006.01)

(52) U.S. Cl. ..... 244/3.14; 244/3.1; 244/3.11; 89/1.11; 342/61; 342/62; 342/147; 342/149; 342/175; 342/188; 342/195

(58) Field of Classification Search ..... 342/59, 342/61–68, 73–75, 80, 147, 149–154, 175, 342/188, 165–174, 195; 244/3.1–3.3; 89/1.11, 89/6, 6.5; 102/382, 384, 473, 501, 513; 174/50
See application file for complete search history.

(56) References Cited

U.S. PATENT DOCUMENTS 2,998,941 A * 9/1961 Wilkes ..... 342/188
4,176,814 A * 12/1979 Albrektsson et al. ..... 244/3.15
4,407,465 A * 10/1983 Meyerhoff ..... 244/3.16
4,431,150 A * 2/1984 Epperson, Jr. ..... 244/3.21
4,537,371 A * 8/1985 Lawhorn et al. ..... 244/3.22
4,711,152 A * 12/1987 Fortunko ..... 89/6.5
4,899,956 A * 2/1990 King et al. ..... 244/3.21
5,085,380 A * 2/1992 Barton ..... 244/3.21
5,280,751 A * 1/1994 Muirhead et al. ..... 102/513
5,381,445 A * 1/1995 Hershey et al. ..... 102/501
5,414,430 A * 5/1995 Hansen ..... 342/188
5,425,514 A * 6/1995 Grosso ..... 244/3.22
5,455,587 A * 10/1995 Schneider ..... 342/62
5,775,636 A * 7/1998 Vig et al. ..... 244/3.24
5,788,178 A * 8/1998 Barrett, Jr. ..... 244/3.11
5,788,180 A * 8/1998 Sallee et al. ..... 244/3.21
6,163,021 A * 12/2000 Mickelson ..... 244/3.2
(Continued)

FOREIGN PATENT DOCUMENTS

JP 3-99199 A * 4/1991
(Continued)

*Primary Examiner* — Bernarr E Gregory
(74) *Attorney, Agent, or Firm* — John A. Miller; Miller IP Group, PLC

(57) ABSTRACT

A guidance system for actively guiding a projectile, such as a bullet after it has been fired from a gun. The guidance system includes a radar unit that includes a plurality of receiver arrays. An optical scope is also mounted to the gun for optically sighting a target. An inertial measurement unit provided on the gun locks onto the target after it has been sighted by the scope, and provides a reference location at the center of the receiver arrays from which the bullet can be directed. The receiver arrays receive radar monopulse beacon signals from the bullet. The signals from the bullet are used to identify the position of the bullet and the roll of the bullet. The signals sent to the bullet provide flight correction information that is processed on the bullet, and used to control actuators that move steering devices on the bullet.

24 Claims, 10 Drawing Sheets

U.S. PATENT DOCUMENTS 6,474,593 B1 * 11/2002 Lipeles et al. ..... 244/3.21
6,483,455 B2 * 11/2002 Fleury et al. ..... 342/62
6,744,637 B2 * 6/2004 Blazic et al. ..... 174/50
7,079,070 B2 * 7/2006 Kongelbeck et al. ..... 342/62
7,163,176 B1 * 1/2007 Geswender et al. ..... 244/3.27
7,589,663 B1 * 9/2009 Goldman et al. ..... 342/62

FOREIGN PATENT DOCUMENTS

JP 4-104000 A * 4/1991
JP 4-177099 A * 6/1992

* cited by examiner

PRECISION GUIDED MUNITIONS

CROSS-REFERENCE TO RELATED APPLICATIONS

This application claims priority to U.S. Provisional Patent Application Ser. No. 61/049,601, filed May 1, 2008, titled Monopulse Active Guidance for Independently Controlled Bullets and to U.S. Provisional Patent Application Ser. No. 61/058,097, filed Jun. 2, 2008, titled Precision Guided Munitions.

BACKGROUND OF THE INVENTION

1. Field of the Invention

This invention relates generally to guided munitions and, more particularly, to a system for guiding a projectile, where the system provides monopulse radar active guidance for independent control.

2. Discussion of the Related Art

Snipers and sharp shooters are valuable for both their lethality and their disproportionate ability to limit the maneuverable battle space of hostile infantry. The ability of a sniper to selectively engage and kill an enemy at distances over one mile has a paralyzing effect on an adversarial combat force. Given the tempo of operations common in asymmetric warfare, it is often too late to deploy support by the time an engagement has begun, and a commander must depend on assets already in place. One way to address the issue of sniper availability is to provide a squad-level weapon that can give any war fighter the range and killing ability of a sniper.

SUMMARY OF THE INVENTION

In accordance with the teachings of the present invention, a guidance system is disclosed for actively guiding a projectile, such as bullet after it has been fired from a gun. The guidance system includes a radar unit having a plurality of receiver arrays. An optical scope is also mounted to the gun for optically sighting a target. An inertial measurement unit provided on the gun locks onto the target after it has been sighted by the scope, and provides a reference location at the center of the receiver arrays from which the bullet can be directed. The arrays receive radar monopulse beacon signals from the bullet. The signals received by the radar unit from the bullet are used to identify the position of the bullet and the roll of the bullet. The signals sent to the bullet from the radar unit provide flight correction information that is processed on the bullet, and used to control actuators that move steering devices on the bullet.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a radar system for guiding a projectile is merely exemplary in nature, and is in no way intended to limit the invention or its applications or uses.

Figure 1:
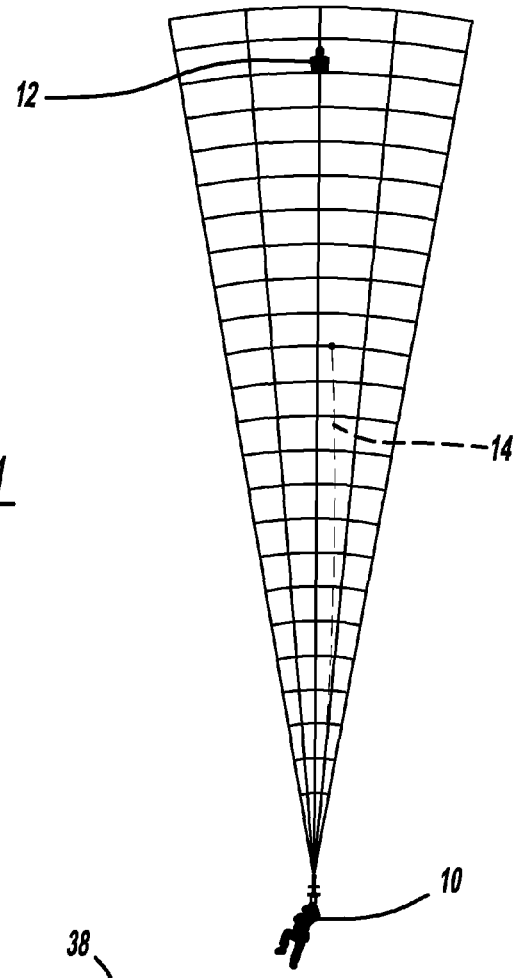
FIG. 1 is an illustration of a soldier shooting a guided bullet that is being adaptively steered to its target.

The present invention proposes a monopulse radar system for providing active guidance of a bullet after it has been fired from a gun. In one embodiment, the invention is a monopulse active guidance independently controlled bullet. FIG. 1 is an illustration of a sniper 10 firing a bullet from a rifle at a target 12 some distance away. As will be discussed below, the sniper 10 will acquire the target 12 optically using a scope on the rifle or an optical sighting system nearby, and a monopulse radar system will track the bullet along a flight path 14 towards the target 12. The bullet will make adjustments to its flight so that it will hit the target 12 with a high-degree of accuracy. The guided bullet of the invention provides sniper-like capabilities to any shooter.

In one non-limiting embodiment, the guided bullet is a .50 caliber round that is guided up to ranges of 2 km with a better than 20 cm degrees of accuracy. This accuracy will be accomplished using high-resolution radar tracking and an adaptive communications link to transmit flight correction data to the bullet that is capable of continuously adjusting its trajectory. The bullet guidance system can employ advanced phased array systems.

The proposed guided bullet system of the invention includes six main sub-systems. These sub-systems include a .50 caliber rifle capable of firing guided munitions, a radar unit integrated into the optical sighting system used to acquire the target, a guided bullet that includes the ability to be steered, the ability to communicate, and the ability to provide a beacon, a back-end processor that collects information from an optical range finder, an inertial measurement unit (IMU) to provide positional correction information to the radar, and an integrated power supply for both the rifle and the bullet.

The proposed guided bullet system allows the position and range-to-target to be sighted optically and locked into the targeting system prior to firing. Afterwards, a three-axis inertial measurement system (IMU), integrated into the radar, will begin measuring the pointing deviations from a locked position. Data from the IMU will maintain the scope reference position during firing, recoil and recovery even in the case where the shooter is acquiring a new target. Immediately after firing, the array transceiver system will initiate communications with the bullet, providing a phase coded mask that will be used to mitigate the effects of intentional and unintentional jamming, such as radio frequency interference with other guided bullets. After initialization, the bullet responds using its assigned phase coding. The radar estimates the on-bullet clock to synchronize beacon operation and flight correction data transfer. During guided flight, RF operations at the rifle alternate between beacon monopulse measurement and communication. In the beacon monopulse mode, the bullet transmits an encoded set of predetermined polarizations referenced to a particular flight control surface. The use of a set of polarizations eliminates the effects of amplitude variance between the transmitter and receiver, basically enabling differential measurement.

The radar receiver on the rifle uses the beacon in a passive monopulse detection scheme to locate the bullet with an accuracy better than 0.020° in both elevation and azimuth. The roll of the bullet is measured by comparing the amplitudes of the encoded polarization sequence referenced to the linear polarization of the receiver. Absolute roll is determined by knowing the initial orientation of the bullet and tracking changes over the course of the flight path. Based on the roll and position measurement, flight correction is calculated and transmitted back to the bullet, closing the control loop. Range information is derived by measuring the two-way time-of-flight for a request to transmit from the radar and a transmission from the projectile.

Figure 2:
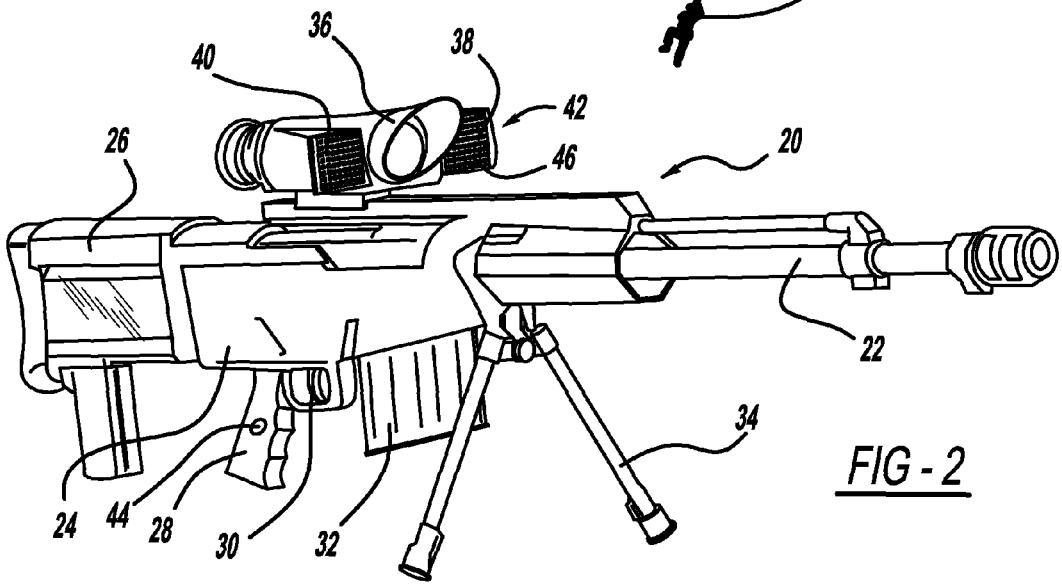
FIG. 2 is an illustration of a sniper rifle equipped with a system for providing bullet guidance after the bullet has been fired, according to an embodiment of the present invention.
Figure 3:
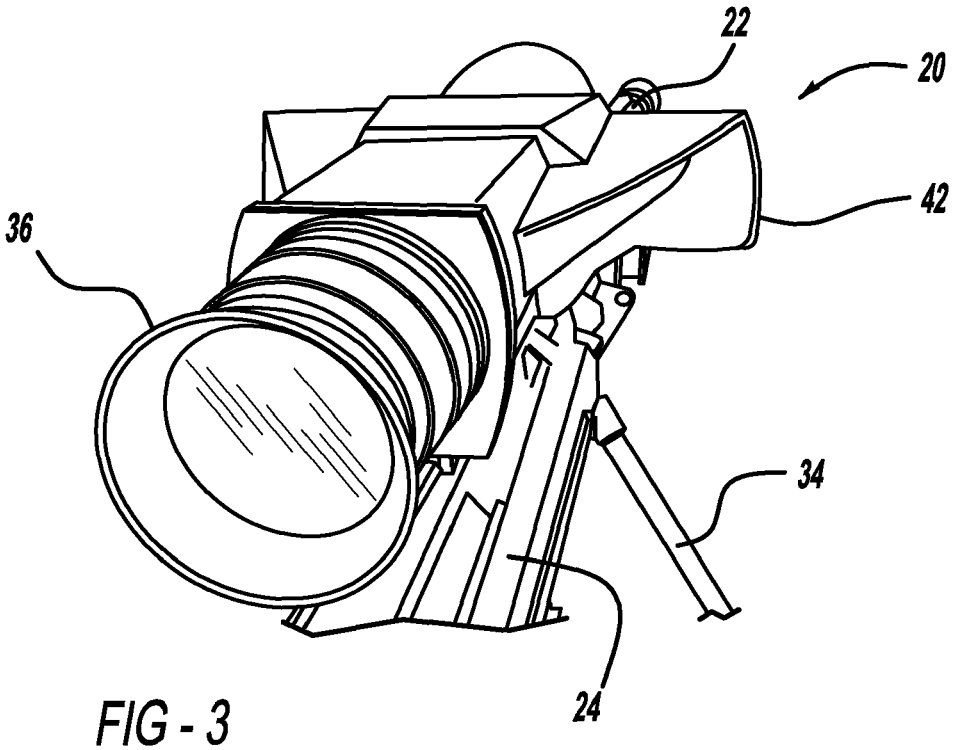
FIG. 3 is a broken-away, rear perspective view of a radar unit and scope mounted rifle shown in FIG. 2.

FIG. 2 is a perspective view of a sniper rifle 20 that fires and then guides a guided bullet using radar tracking, as discussed above. The rifle 20 includes a barrel 22, a receiver 24, a stock 26, a grip 28, a trigger 30, a magazine 32 and a stand 34. A switch 44 on the grip 28 activates the guidance system to acquire the target before the bullet is fired. The rifle 20 also includes a radar transceiver unit 42 and a scope 36 mounted to the top of the receiver 24. The transceiver unit 42 includes two transceiver antenna arrays 38 and 40 mounted on opposite sides of the scope 36, as shown. The antenna arrays 38 and 40 include a plurality of antenna elements 46, here patch antenna elements, although other types of antenna elements may be equally applicable. FIG. 3 is a broken-away, perspective view of the rifle 20 showing a back view of the scope 36 and the transceiver array 42.

Figure 4:
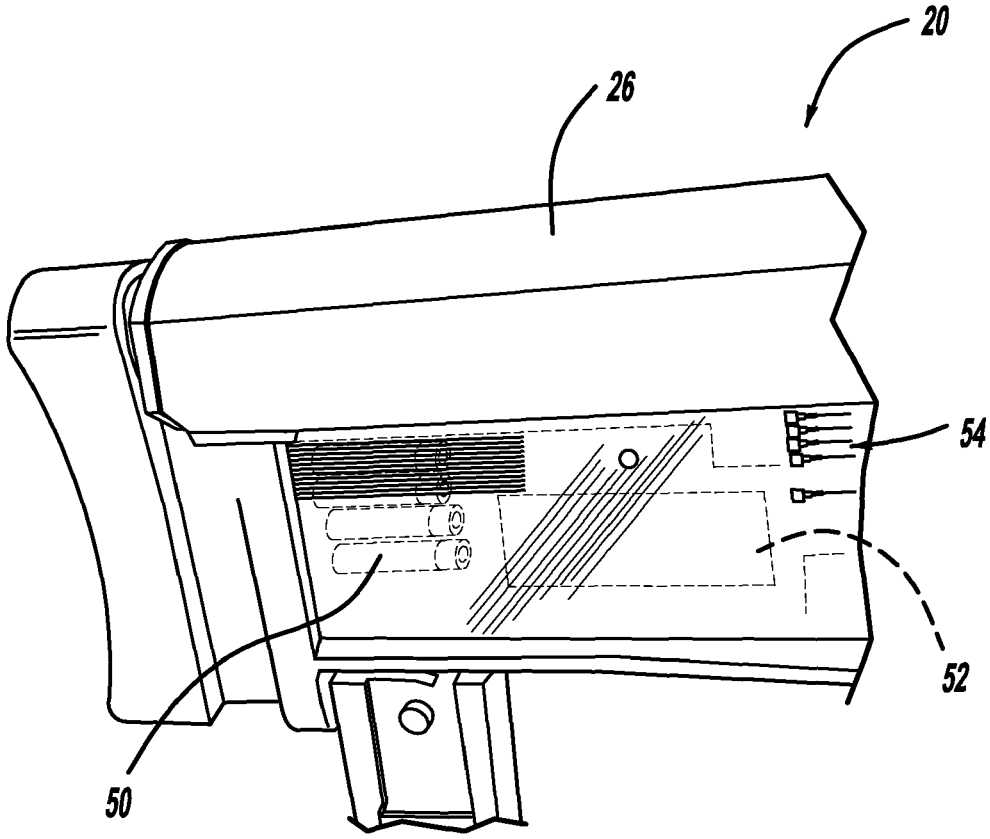
FIG. 4 is a broken-away perspective view of the stock of the rifle shown in FIG. 2.

FIG. 4 is a broken-away perspective view of the rifle 20 showing the stock 26. In this non-limiting embodiment, the stock 26 houses various parts of the guidance system including batteries 50, an inertial measurement unit (IMU) 52 and processing circuitry 54.

Figure 5:
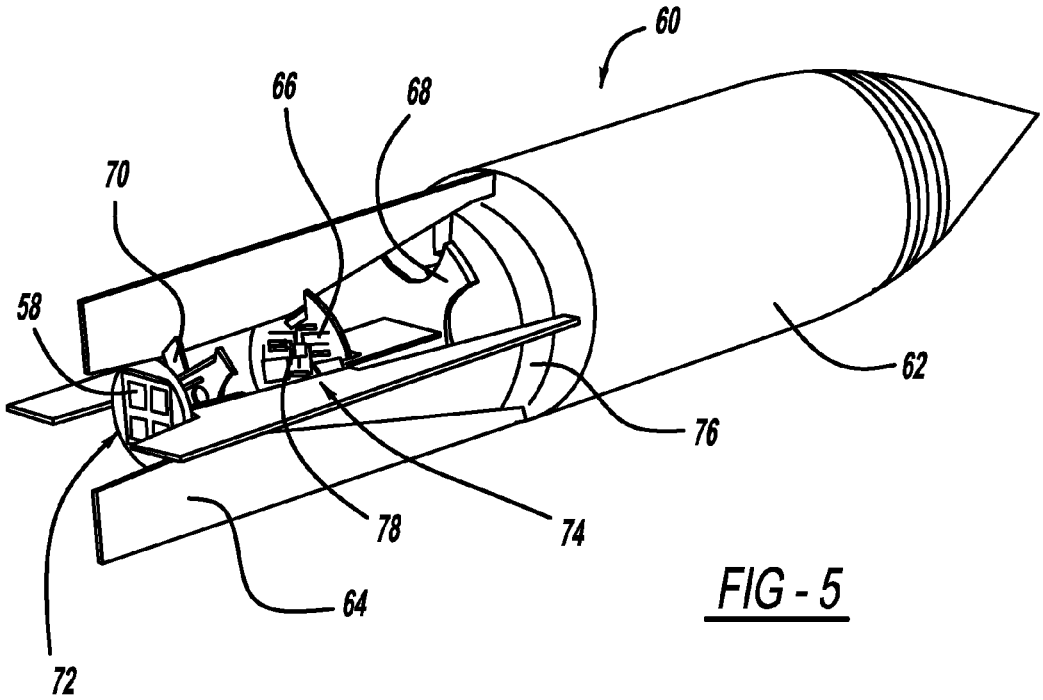
FIG. 5 is an illustration of a .50 caliber bullet including an RF transceiver and flight actuators that provide bullet guidance, according to an embodiment of the present invention.

FIG. 5 is a perspective view of a guided bullet 60 of the type discussed above that is fired and guided by the rifle 20, according to an embodiment of the present invention. The bullet 60 includes a projectile portion 62 at the front of the bullet 60 and guidance fins 64 at a rear of the bullet 60. The guidance fins 64 are moveable on actuators 66, 68 and 70 that can be controlled by the guidance system in the bullet 60, as will be discussed in more detail below. The actuators 66, 68 and 70 that move the fins 64 can be any suitable actuator for the purposes described herein, such as piezoelectric actuators. The bullet 60 includes a dual-polarized patch antenna array 72 having patch antenna elements 58 at the rear of the bullet 60 between the fins 64 that receive and transmit the RF signals consistent with the discussion herein. A battery 76 provides power to the various electrical devices on the bullet 60. The bullet 60 also includes processing circuitry 74 for processing, power management and flight control. The bullet 60 also includes a fusible switch 78 that turns on the circuitry 74 when the bullet 60 is fired.

Figure 6:
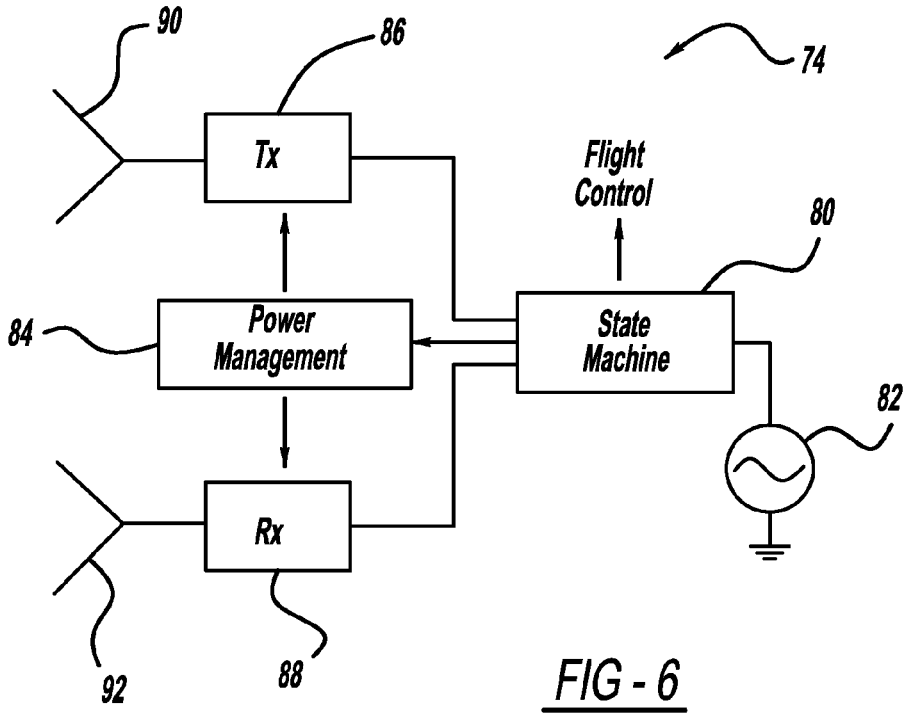
FIG. 6 is a block diagram of an RF transceiver module provided on the bullet shown in FIG. 5.

FIG. 6 is a block diagram of the processing circuitry 74 as one non-limiting embodiment. The processing circuitry 74 includes a state machine 80 that is powered by a power source 82 representing the battery 76. The circuitry 74 also includes a power management device 84 that provides power to a transmitter 86 and a linearly-polarized receiver 88 controlled by the state machine 80. The transmitter 86 includes a vertically polarized antenna 90 and the receiver 88 includes a horizontally polarized antenna 92.

The operation of the guided bullet 60 breaks down into three functions, namely, receive correction data, correct flight path and transmit a radio frequency beacon. The communication functions of the bullet 60 require that a full transceiver module be packaged in the bullet 60. The correction data will be received in a single polarization, down-converted to IF, and demodulated according to a phase coding mask stored in the state machine. Flight control information is then decoded and written to data registers. Flight surfaces, such as the fins 64, are actuated using level shifted control signals from the state machine 80. In the beacon-mode, the bullet 60 will transmit a sequence of three predetermined polarizations, such as −30°, 0° and 30°, which allows the linearly-polarized receiver 88 to accurately determine the bullet's orientation. This scheme makes it possible to account for signal strength variations of rising from part-to-part tolerance and to accurately track the absolute roll of the bullet 60.

A target is acquired through the normal optical sighting process using the scope 36. It is assumed that the active range-finding is provided by the optics that will be operated through controls on the grip 28 of the rifle 20. When the target has been acquired and the range determined, the guidance system is locked. The current orientation of the rifle 20 is set by pressing the switch 44 on the grip 28, or possibly by a switch that is closed by a half-pull of the trigger 30. This establishes bias power to the radar and initiates the position/orientation tracking function of the 3-axis IMU 52 integrated in the stock 26 of the rifle 20. In this manner, the orientation of the rifle 20 relative to the target is known at all subsequent times and this information is used to provide guidance. The IMU 52 must provide sufficient accuracy of the rifle's angular orientation at a rate that allows for correction of rifle motion. Thus, when the shooter is ready and the bullet 60 is fired, the bullet 60 will home to the position initially sighted regardless of the subsequent motion of the rifle 20.

Projectile acquisition masking is generally provided between time 0-4 ms. The fusible switch 78 in the bullet 60 is tripped by the concussion of firing, powering up the circuitry 74. The purpose of the fusible switch 78 is to preserve battery power over the storage life of the bullet 60. After firing, the rifle 20 establishes initial communications with the bullet 60 and measures polarization and roll of the bullet 60. In order to prevent detection and the initiation of countermeasures, the transmitting array module will initially operate in a low-directivity, low-power mode. The initial communication is a low-data rate transfer that contains the phase-coding that will be used by the bullet 60 during the remainder of its flight. This coding protects the radar from seduction and jamming while spreading the power spectrum of the transmitted signal to prevent detection. This coding also mitigates RF interference arising from independently operated, co-located guided bullets. When the guided bullet 60 has received and processed the initialization data, it transmits a beacon pulse to the rifle 20 using its assigned code. The beacon signal from the bullet 60 is used to estimate the frequency of the on-bullet clock. This estimation process allows the coordination of flight correction and beacon modes during guided flight.

During the time from 4 ms to 100 ms after firing, the bullet 60 will experience its most rapid deceleration and turbulence. During this time, it will not be possible to correct errors in the roll or flight path.

During time 100 ms to 4500 ms after firing, the bullet 60 is in a stable guided flight as its transceiver toggles between beacon-mode and receiving-mode. Initially, the radar unit 42 on the rifle 20 operates in a low-directivity, low-power transmission mode to prevent detection or the initiation of countermeasures. As the range increases, the directivity and transmitted power of the transmit array module increases as more elements are engaged. This is a significant benefit of the proposed system. Because the bullet 60 will be transmitting a beacon back to the rifle 20 with a significant on-target pattern null and because the transmit beam at the rifle 20 can be adaptively shaped, keeping transmit power at the minimum level required to maintain an acceptable bit error rate and signal detection becomes practically unworkable. At short range, the total coherent integration time required by the radar unit 42 is comparatively small. As the range increases, increasingly long beacon intervals are required. By the last phase of the bullet fight, total beacon-mode intervals will be on the order of milliseconds.

At time 5000 ms, the electronics of the bullet 60 go silent.

Figure 7:
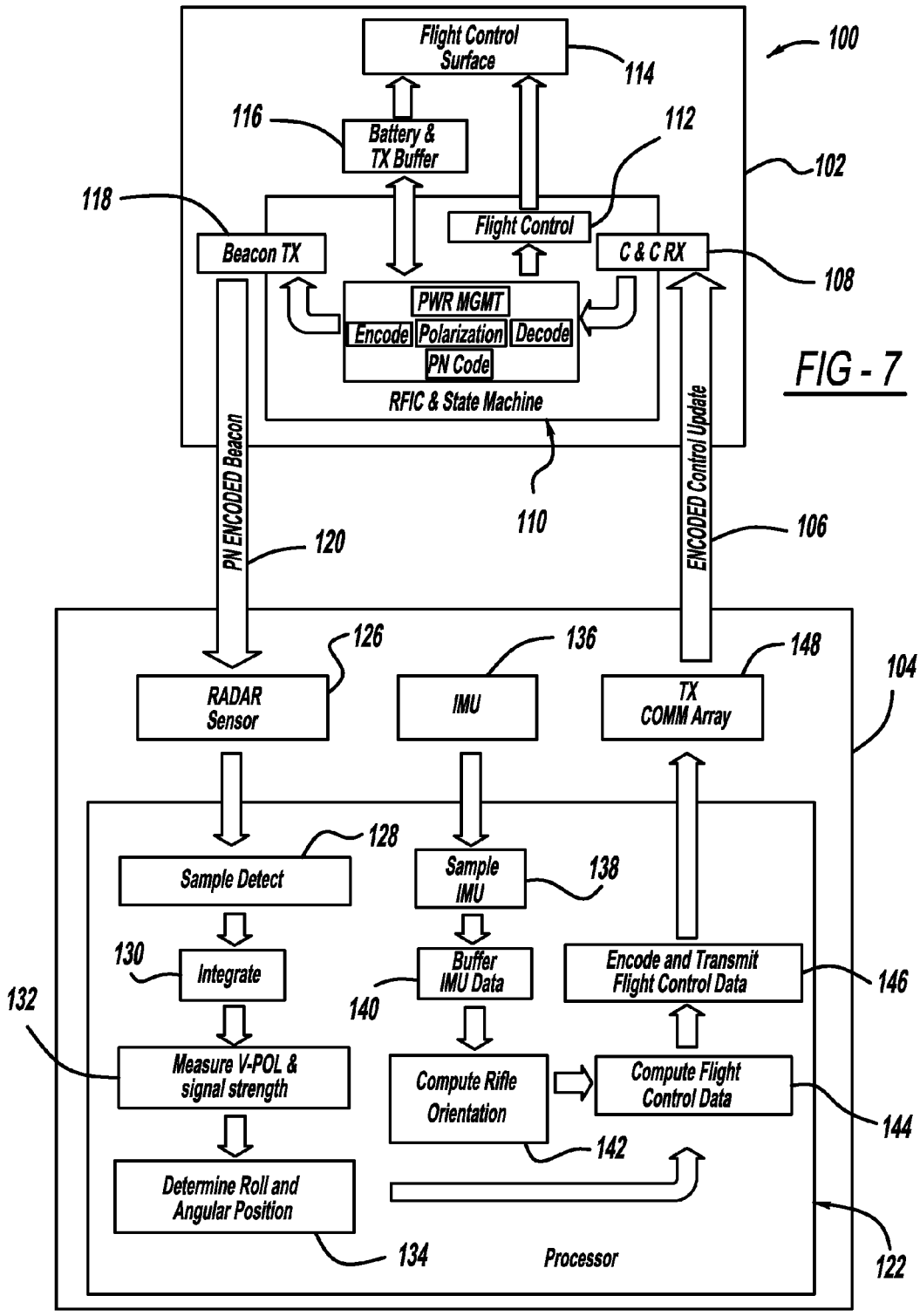
FIG. 7 is a block diagram of a bullet guidance system providing a closed control loop between a processor on the sniper rifle and a guidance control system on the bullet, according to an embodiment of the present invention.

FIG. 7 is a block diagram of a bullet guidance system 100 of the type discussed above, according to an embodiment of the present invention. The system 100 includes a unit 102 representing the guided bullet electronic controls on the bullet 60 and a targeting and tracking unit 104 representing the targeting and tracking controls at the rifle 20. The unit 102 receives encoded directional information from a radar beacon 106 provided by the unit 104. Transmitted trajectory update commands in the beacon 106 are received by a command and control receiver 108 on the unit 102 that provides some front-end processing, such as frequency down-conversion, and provides the signal to an RF integrated circuit and state machine 110. The RFIC and state machine 110 provide power management, decoding, encoding and polarization control, as will be discussed in further detail below. The decoded guidance information is sent to a flight control processor 112 that controls actuators 114 on the unit 102. Power management signals are provided to a battery and signal conditioning circuitry 116 that powers the actuators 114. Further, the RFIC and state machine 110 generate a PN encoded beacon signal that is sent to a beacon transmitter 118 that generates a signal that is transmitted back to the tracking and targeting unit 104 identifying the bullet's position.

An encoded beacon signal 120 from the unit 102 is received by a radar array 126 on the tracking and targeting unit 104, where it is sampled and detected at box 128, integrated at box 130 and its vertical polarization is measured at box 132 in a processor 122. From the vertical polarization, the roll and angular position of the unit 102 is determined at box 134. The position of the unit 102 is determined relative to the center of the arrays 38 and 40. An IMU 136 is used to null motion of the center of the arrays 38 and 40 so as to provide a reference for the received signal. The IMU 136 is sampled at box 138 and the IMU data is buffered at box 140. The orientation of the unit 104 is determined at box 142, and the orientation of the unit 104 and the roll angular position of the unit 102 are then sent to box 144 that computes the flight data to steer or guide the unit 102. The flight control data is then encoded at box 146 and transmitted by transmitter 148. The proposed beacon-communication frequency for the guided bullet concept can be selected to be near 30 GHz. It may be desirable however to shift to higher frequencies in future systems to reduce the likelihood of counter measures being developed.

Each element in the arrays 38 and 40 is a completely independently weighted transceiver that provides excellent watt-to-watt efficiency required by battery-powered operation and the ability for multi-beam and null-steering known as an active electronically steered array (AESA). Highly-miniaturized RF electronics allows extremely compact transceiver modules for use in the harsh environment of a supersonic bullet. Beamforming technology allows the guided bullet's flight controller to be integrated directly into the rifle 20. These levels of integration provides a fire and forget capability that guides the bullet 60 along its most natural ballistic trajectory while the shooter is free to engage new targets or respond to other threats.

Using an AESA for millimeter/wave communications, passive monopulse radar has distinct advantages over optical illumination and beam-riding methods. The use of beam steering allows the radar to quickly adjust to maintain target tracking even if misaligned or undergoing violent acceleration during recoil. This allows the tracking and guiding system to be integrated directly with the rifle 20 without the need for mechanical stabilization. There is no need for precise alignment after the initial sighting, making this a fire-and-forget weapon, where radar alignment must be maintained to ±45 g. Using radar tracking rather than optical guidance allows the bullet 60 to follow its optimal ballistic trajectory rather than a flat trajectory to the target such as required by a beam rider guidance system. This reduces the requirements of the flight control system and provides higher impact energy because the bullet 60 only needs to correct deviations from its ballistic course rather than sacrifice air speed to overcome the force of gravity. Unlike RF systems that paint the target during the entire flight, a millimeter/wave system can use adjustable power levels and spread spectrum pulse compression to hinder detection and the initiation of counter measures.

By assigning each bullet a unique address and communication coding, the bullet 60 is protected from jamming and seduction. Further, radar has all-weather capability. Based on a single optical sighting and range, the bullet 60 can be guided through rain, fog, snow, smoke, dust or haze without the signal degradation of optical systems subjected to these complicating environmental factors.

The use of AESA technology also has distinct advantages over similar fixed-aperture monopulse systems. Waveguide fed horn antennas, a common monopulse architecture, are inherently large and heavy, and must be mechanically steered to maintain SNR as the target moves with respect to the rifle boresite. By contrast, the AESA technology is only 15-20 mm deep regardless of the total aperture size. In a 64-element array configuration, each quadrature antenna will have 16 independent receivers, providing protection against multi-point failure and improvement in noise figure. Instantaneous electronically controlled beam-pointing makes it possible to keep a projectile optimally in-beam even if the radar antenna has moved off target or as the projectile arcs over a ballistic trajectory.

The present invention proposes applying a multi-use AESA architecture to establish both a radar and communication link with the bullet 60, and to design and construct highly miniaturized on-bullet RF transceivers. The RF electronics required to provide the bullet control will need to withstand approximately 40,000 Gs of acceleration at the time of firing. To survive these conditions, the RF electronics must be highly-miniaturized, low-mass and packaged in a low-thermal conductivity potting material. An advantage of using a compact integration scheme is survival of firing accelerations. The low mass of highly compact modules reduces forces and allows for compliant potting around the electronics. A firmly-isolated, local ground plane will be created in the potting of the electronics on the bullet 60 to support the common-ground requirements of the transceiver electronics. Battery power to the circuit 74 will be established at the time of firing by a miniature inertial switch, such as the switch 78.

The position of the bullet 60 in azimuth and elevation can be determined by beacon monopulse radar. Monopulse radar is a high-resolution method of determining a point-like target's angular position with only a single-pulse. Monopulse radar is capable of providing much higher angular resolution than scanning methods while maintaining a substantially lower data rate. Beacon monopulse radar is the passive radar implementation of monopulse radar in which the target emits a signal that is detected by the radar. In beacon-mode, the design variables that govern the SNR are the beacon to power $P_t$ and the compressed-pulse integration time $N\tau_c$ where N is the number of coherently summed pulses and $\tau_c$ is the pulse compression time. From this, the SNR can be given as:

$$SNR = \frac{P_t N \tau_c G_t G_r \lambda^2}{(4\pi R)^2 k T_0 F}$$

Where $G_t$ and $G_r$ are the gains of the bullet's antenna and the receive array, respectively, $\lambda$ is the wavelength, R is the range and $kT_0F$ is the input equivalent noise density of the receiver.

Higher pulse compression ratios or more coherent averages can be used to increase the SNR of the link, particularly at greater ranges where maintaining resolution becomes more difficult. Angular resolution as a fraction of the antenna beamwidth is inversely proportional to the square root of the SNR. The approximate angular error in a given direction $\sigma_x$ for phase-sensing monopulses can be given as:

$$\sigma_x = \frac{M2\beta_x}{\pi\sqrt{SNR}}$$

Where SNR is the signal to noise ratio and $\beta_x$ is the sectoral pattern beamwidth.

In order to achieve the 0.1 milliradian accuracy required to guide a projectile to within 20 cm at 2000 m, SNR of 40 dB or higher can be required. This indicates integration times on the order of milliseconds at maximum range. At maximum range, long integration times or higher beacon power may be necessary to achieve the desired accuracy.

Figure 8:
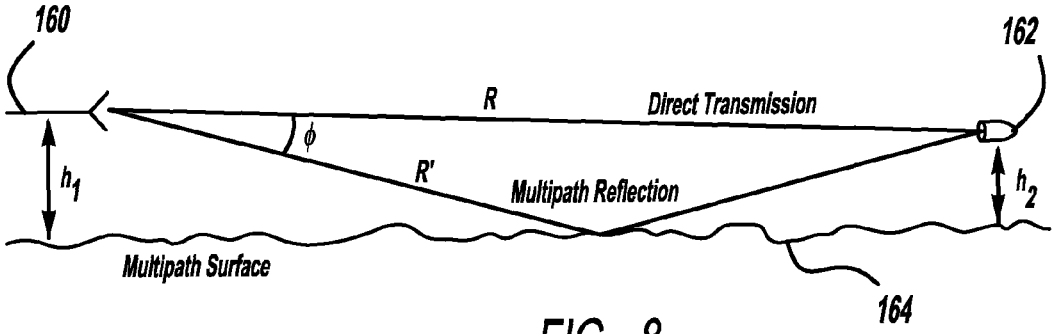
FIG. 8 is an illustration showing multipath reflections from the ground between a radar unit on a rifle and a bullet in flight.

Monopulse radar is intended to track a single target with high accuracy, and is particularly susceptible to the effects of clutter and multipath. FIG. 8 is a representation of a radar unit 160 on the rifle 20 and a bullet 162, where the bullet 162 travels along a multipath surface 164. A direct transmission between the radar unit 160 and the bullet 162 is shown by path R and a multipath reflection off of the surface 164 is shown by path R'. Many methods have been developed in the art to cancel the effects of multipath, but each makes strong assumptions about the scattering surfaces that cannot be made for the general case of varying environments and terrains certain to be found in the operation of tactical projectile guidance system.

Multipath error is the primary impediment to accurately determine the elevation and azimuth position of the beacon. It is caused by a beacon's signal reflecting from the terrain, buildings, walls, power lines, or other features. Conceptually, the simplest type of multipath error results from specular reflection from a relatively flat surface. In the case of the guided bullet 60, multipath induced signal degradation largely arises from scattering off of both rough and/or volumetric scatters. At Ka-band frequencies, most natural terrains, such as tall grass, brush, uneven desert, rocky or gravel surfaces, are probabilistic scatters and do not produce a coherent image. Over enough distance, these scatters can be expected to act as a zero mean noise source and therefore are not troubling. On the other hand, man-made surfaces and objects, such as asphalt, buildings, walls, and a few natural surfaces, such as water, dense snow, and ice, produce specular reflections.

A number of methods can be used to reduce the effects of multipath error. A high-directivity radar receiver antenna helps to mitigate multipath effects. High directivity at the receiver reduces the requisite SNR and narrows the beamwidth so less indirect multipath clutter is received. The 32×32-element receive array proposed for this system will have a beamwidth of approximately 4°. Multipath from scatters more than ±2° from the target line-of-sight are thus substantially attenuated. The effects of high antenna directivity are most beneficial when the shooter is very near to the ground and the specular multipath reflection point is near the shooter.

Using a large modulation bandwidth is another technique to eliminate multipath error. Since signals at different frequencies have different phase delays, waveforms decorrelate as a function of increasing bandwidth. Another benefit of higher bandwidth techniques can be particularly successful in reducing the effects of multipath signals if the total time delay can be resolved and range gated. In one embodiment, a spread spectrum coded beacon signal using a phase-modulated pseudorandom noise code (PN-code) is employed. In this case, if a multipath signal has been delayed by more than one chip period of the PN code, it is decorrelated from the direct signal after demodulation. A PN code is generated by switching the phase between from 0° and 180°. The switching rate, or chip rate, determines the bandwidth of the signal.

The multipath signal can be isolated and rejected because a reflected signal has a different path length than the line-of-sight signal. Assuming a flat specular surface and low elevation angle, which is the worst case scenario, the difference in path length is given by:

$$R^1 - R \approx \frac{2h_1 h_2}{R}$$

If a signal is delayed by more than on modulation chip and the delayed code is orthogonal with the undelayed code, then the multi-path signal is strongly decorrelated in the demodulation and its effects greatly reduced. For instance, a 2 GHz bandwidth corresponds to 15 cm of additional path length to delay the reflected signal by one chip. Thus, if the PN code is orthogonal with its shifted image, a shooter 1 m away from a flat multipath surface could resolve a beacon if it is 15 m from the same surface at 2000 m, 7.5 m at 1000 m, and 3 m at 500 m. Given the actual trajectories of the .50 caliber bullet, the use of a higher modulation frequency makes it possible to uniquely track the beacon over many flat terrain features. In the case when the specular reflection angle is out of the radar beam the effects of multipath are significantly reduced.

Figure 9:
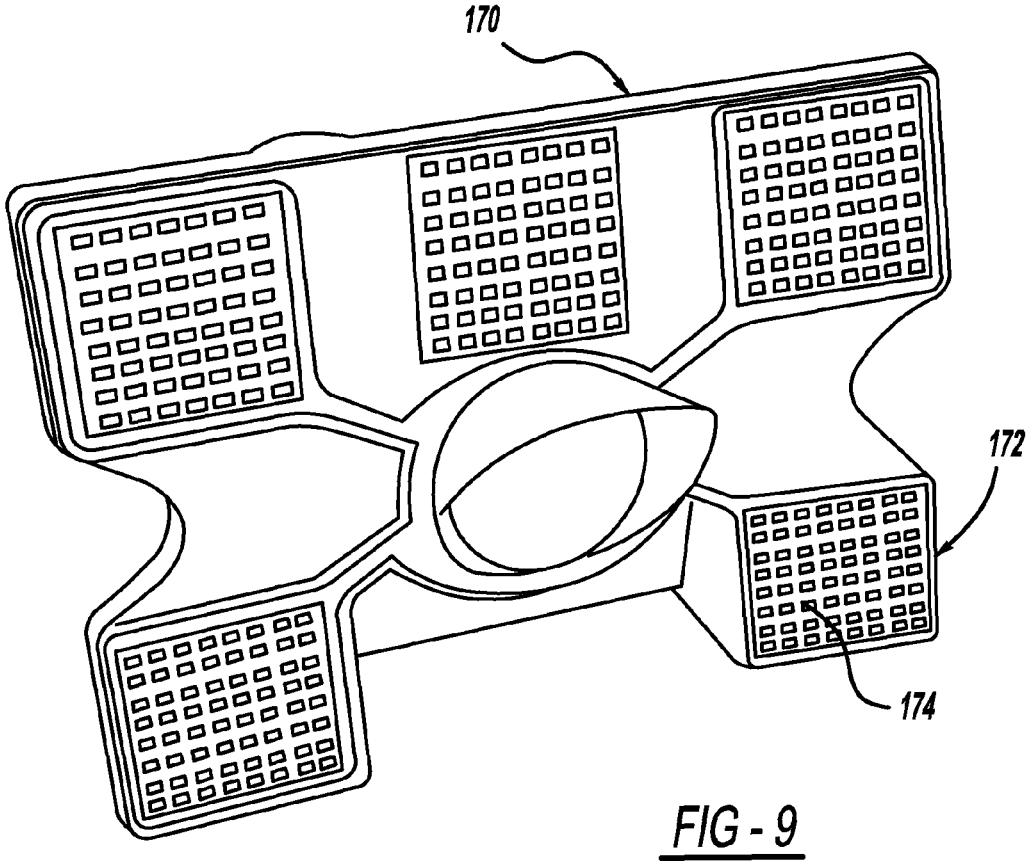
FIG. 9 is a front, perspective view of a radar unit for the rifle shown in FIG. 2 including multiple receivers, according to another embodiment of the present invention.

FIG. 9 is a perspective view of a radar unit 170 that can replace the radar unit 42 in an effort to help with multi-path errors. In this embodiment, the radar unit 170 includes four receiver phased-arrays and one transmitter phased-array 172 including patch antenna elements 174 that form the AESA. The unit 170 provides separate apertures that have the effect of increasing the radar sensitivity, decreasing the beamwidth and increasing the directivity at the expense of creating grating lobes. Higher directivity at the beacon and the radar receiver are advantageous. Higher directivity at the beacon produces more radiation in the direct line-of-sight, and less in stray multipath directions. High directivity at the receiver reduces the requisite SNR and narrows the beamwidth so less indirect multipath clutter is received. In this system, the beamwidth can easily be narrowed by using multiple discrete apertures at the expense of creating grating lobes. However, the grating lobes can be set to angles where the contribution of multipath is likely to be small and which can be easily range-gated.

There are several methods to estimate the multipath induced error in a monopulse system. Using Bayesian estimation of the current position based on the certainty of the measurement and the prior trajectory, it is possible to maintain sub-milliradian accuracy even with high uncertainty during some phases of bullet flight. It is possible to avoid many multipath effects and errors by using a higher trajectory than the optimal ballistics path. During the terminal phase of flight and in some low-elevation scenarios, it may become necessary to operate in what is known as a Low-E mode in which elevation tracking and course correction is disabled. Azimuth detection and correction would remain unaffected. The effects of operating in this mode at the end of controlled flight should not be problematic since it is expected that course corrections to the bullet 60 will necessarily become smaller as the bullet 60 nears the target.

Environments in which it will be most difficult for the guided bullet 60 to be used are the most cluttered cases. However, these are also the cases where it is unlikely that a soldier can attempt a 1-2 km shot. A soldier, for instance, is unlikely to find 1000 m of unobstructed view in a forest, along an alleyway or down a city street. The best application of this technology is firing from elevated positions, such as from a tower, rooftop or hill. It is also worth noting that this technology can easily be adapted to aircraft and UAVs with minimal alterations to the radar.

Figure 10:
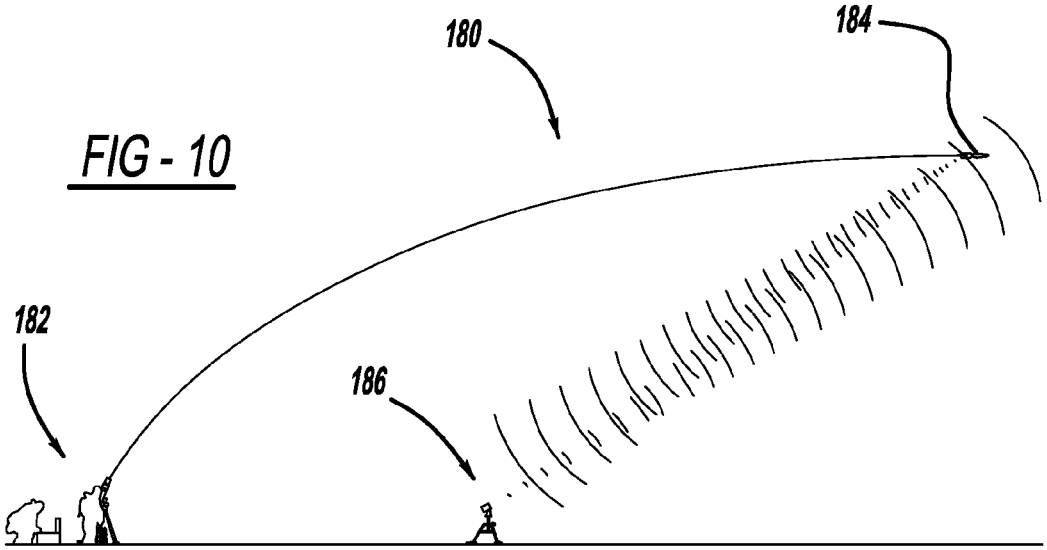
FIG. 10 is an illustration of a radar system tracking and guiding an indirect fire projectile.

Although the discussion above and below is more specifically directed to guided bullets and guided indirect projectiles, it will be appreciated by those skilled in the art that the RF tracking and guidance system of the invention will have application to other guided projectiles. FIG. 10 shows a general representation 180 of a mortar team 182 firing a mortar 184 that is tracked and guided by radar systems 186 as one alternative projectile.

The baseline concept is that the guided indirect projectile to be steered uses canards incorporated on the fuze. Piezo-actuated flight control surfaces can provide sufficient control authority to accurately and significantly steer/divert a mortar over the 5600 m trajectory. The steered projectile is tracked using a beacon-monopulse radar located near the mortar emplacement. In this configuration, the projectile emits a signal of 10 mW or more, at microwave frequencies up to 35 GHz signal beacon from the fuse assembly. The RF beacon is tracked using a highly compact and inexpensive phased-array operating as a passive mono-pulse radar receiver. Flight path corrections are calculated by comparing the measured trajectory with the ideal trajectory, and flight control commands are transmitted from the emplacement to the steerable round.

Indirect fire support for military operations in urban terrain (MOUT) must have the capability to engage adversaries hidden in urban canyons. The preset mortar round will have sufficient flight control authority to permit a 200' straight down trajectory at the terminal point of the ballistic flight path. An additional benefit of the communication link is in-flight fuze programming. Connection of the fire control computer to the communication system/radar makes this method of fuze programming easily realized. This also makes the unguided ballistic trajectory the failsafe default, since the canards will not deploy until communication is established.

One significant capability improvement that is within reach using this approach is the simultaneous precision engagement of multiple independent targets. By implementing an effective TDMA channelization scheme and using electronically steered phased array radar, the present system can track and simultaneously control multiple in-flight projectiles.

Active guidance and flight control provides a means to compensate for wind and other disturbances without the inherent difficulties and limitations of atmospheric characterization. RF guidance is superior to optical guidance in low visibility environments where indirect fire is most useful because RF can operate through smoke, dust, rain and snow. A local RF system also provides immunity to the difficulties associated with operation in GPS denied environments. Finally, if it is deemed tactically important, a forward observer can be equipped with a smaller version of the radar to guide the projectile to target with extreme precision at extended ranges and perhaps even allowing for the possibility of engaging moving targets.

In the case of mounted cannons, the use of an electronically-steered phased array can enable shoot-and-scoot operations greatly improving survivability and confounding countermeasures. The use of PN coded RF channels makes seduction and jamming nearly impossible. Passive radar and a standard communication channel with a low-probability-of-detection waveform for COMMS makes detection of the radar very difficult if not impossible.

Prior to firing, the radar system is surveyed into position in a manner that conforms with the current training practices of mortar and artillery teams. The baseline system concept calls for the polar target coordinates and range-to-target to be provided to the radar from the fire control computer. This information may be transmitted via a simple serial link to the radar prior to firing. After launch, the radar acquires the projectile, establishes a time domain multiple access PN coded communication, and begins tracking and flight control. The control system alternates between communication and radar tracking of the beacon. Communication occurs on a low-duty cycle minimally powered UF channel which will be made to appear as though it was a standard voice communication.

Figure 11:
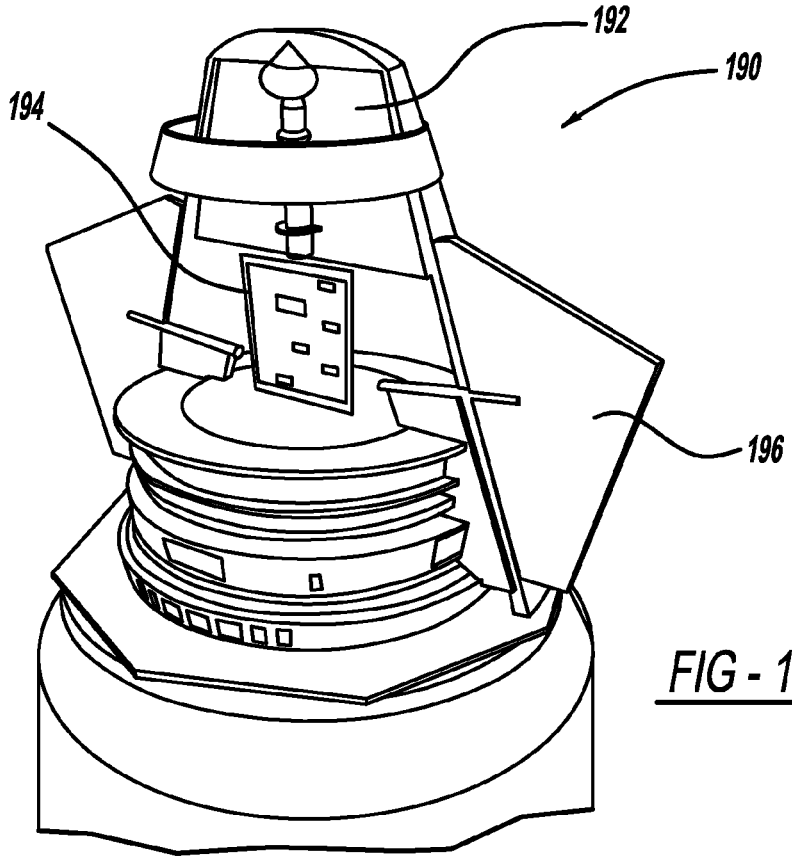
FIG. 11 is a broken-away, perspective view of a precision guidance module within a guided projectile.

FIG. 11 is a broken-away perspective view of a fuze 190 showing various electronics therein with antenna 192 connected to beacon transmitter and guidance control circuitry 194. During the course of flight, deviations from the predicted trajectory are measured with an accuracy of better than 0.0003 radians and corrections to the flight are calculated at the radar. The COMM link updates the kinematic control of the projectile. The key metric of kinematic control is control authority, where there must be enough control authority to accurately steer the projectile to the target. An example of an approach to guide the projectile is to use nose-mounted canards 196 to control the normal acceleration of the projectile.

Figure 12:
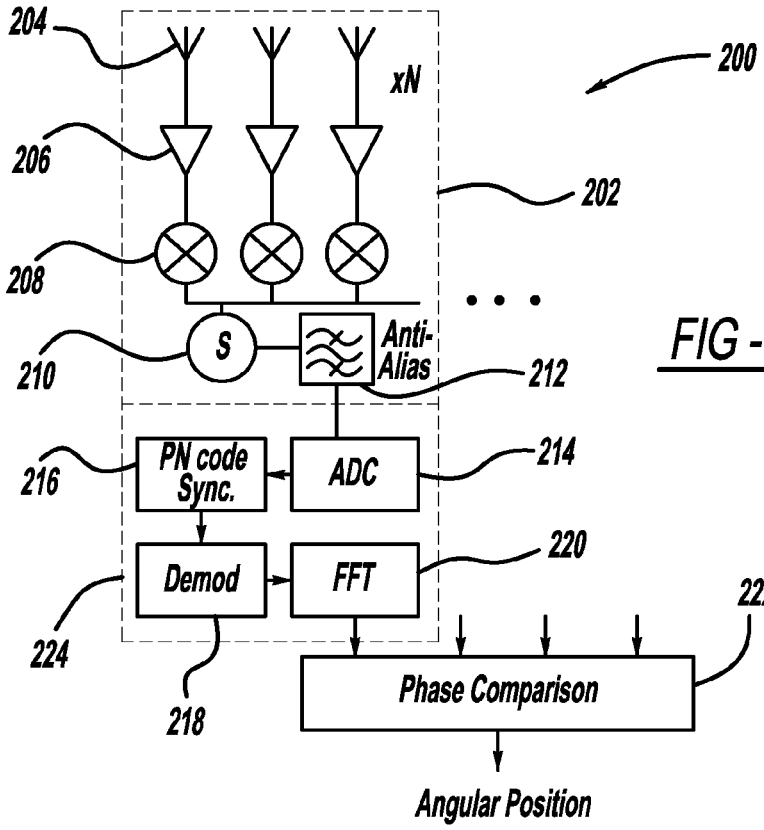
FIG. 12 is a schematic block diagram of a radar processing system for a radar guided projectile.

FIG. 12 is a schematic block diagram of a radar sensor circuit 200, similar to the array 126 discussed above. Quadrature antennas 202 comprise a sum and difference monopulse radar receiver. Each of the quadrature antennas 202 may be comprised of a number of radiating elements 204 forming an AESA as previously described. Signals received at the antennas 202 are amplified by an amplifier 206 and down-converted by a down-converter 208 to an IF and summed by a summer 210. The signal is filtered by a filter 212 and enters a sample/detect circuit 224, such as described above at the box 128. The circuit 224 samples the signal with an analog-to-digital converter 214. The signal is aligned with a mask 216 and demodulated by a demodulator 218 by inverting the mask 216. Finally, a fast-Fourier transform is performed at box 220 and the signal is integrated and analyzed. The phase and/or amplitude information is then compared to find the direction of arrival at box 222 and angular position information is provided. In the digital phase comparison hardware, the phase of the four recovered CW beacon signals is used to determine the position of the beacon with a 1−σ a accuracy of less than 300 μradians. Finally, the projectile's position is communicated to the system guidance.

Figure 13:
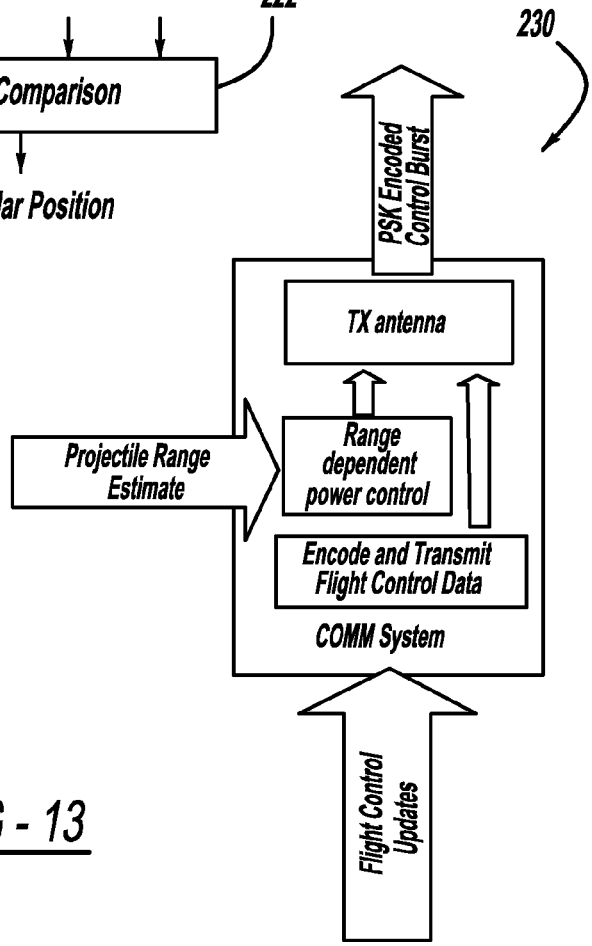
FIG. 13 is a schematic block diagram of a forward communications system for a guided projectile.

FIG. 13 is a schematic block diagram of a communications system 230 for the guided bullet being discussed herein. The purpose of the communication sub-system is to transmit flight correction commands to the projectile. It is important that the communication system not betray the position of the operator. In operation, data is transferred from the guidance block to a standard serial connection to the communication block. The data is buffered into an integrated modem where it is encoded and modulated and provided as the input to the AESA-based 35 GHz upconverter.

To minimize the emission signature of the transmitted signal, an extremely short data packet (no more that 15 bytes) will be transmitted. Bursty time randomized data transfer is one of the best means for reducing the probability of detection for a convert transmitter.

The multi-projectile communication system architecture is a simple master-slave time domain multiple access (TDMA) type, with the radar tracker dynamically allocating time channels for each projectile. This gives the system the greatest flexibility in acquiring positional updates as well providing the most robust method for managing multiple projectiles. Another advantage of this architecture is that it allows the radar/COMM system to estimate the variances in the projectile's onboard clock, which is critical for the delta-time based range estimate. Finally this makes it possible to randomize the transmission time to further inhibit detection.

Figure 14:
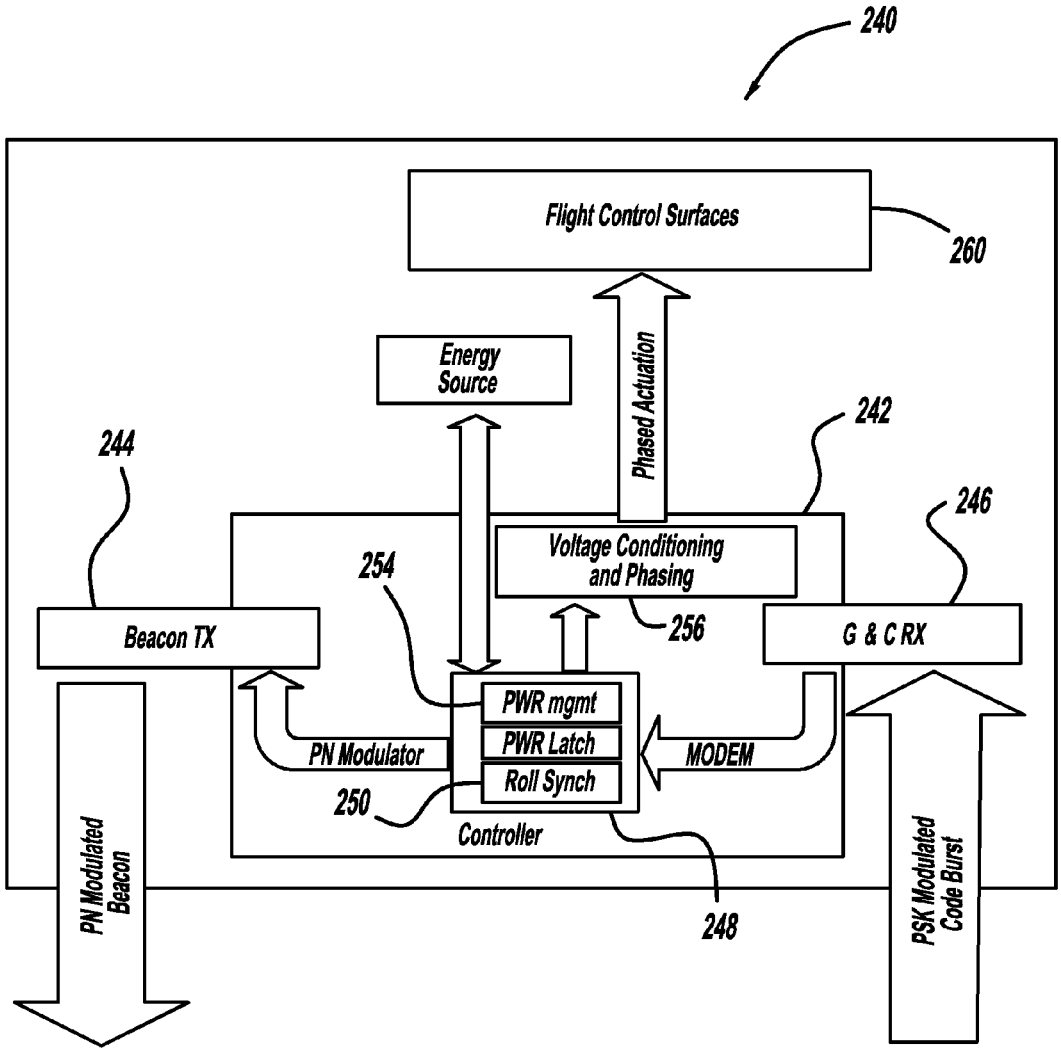
FIG. 14 is a schematic block diagram of electronics in the guided projectile.

FIG. 14 is a block diagram of the projectile's guidance and control package 240. Bullet electronics 242 provide five critical functions. The bullet transmits a phase-modulated beacon by generating PN modulation data in a controller 248 and upconverting to the desired RF frequency in a transmitter 244. The electronics 242 receives and parses flight control updates at receiver 246, determines the bullet orientation, and maintains roll synchronization at a processor 250 within the controller 248 for the resonant control of the flight actuators. Finally, the electronics 242 provides power management at box 254 and voltage conditioning at box 256, and drives actuators 260 which regulate the attitude of the bullet's nose.

An alternative or addition to measuring polarization to determine roll is to use a roll synchronizer that utilizes a 2-axis magnetic sensor that determines the orientation of the bullet with respect to the local magnetic field. The time-varying amplitude of this signal is measured at a comparator input on the microcontroller and an internal counter that is phase-aligned to the rotation rate of the projectile. Up-being zero phase-is referenced to a particular actuator that is aligned with the magnetic sensor.

Figure 15:
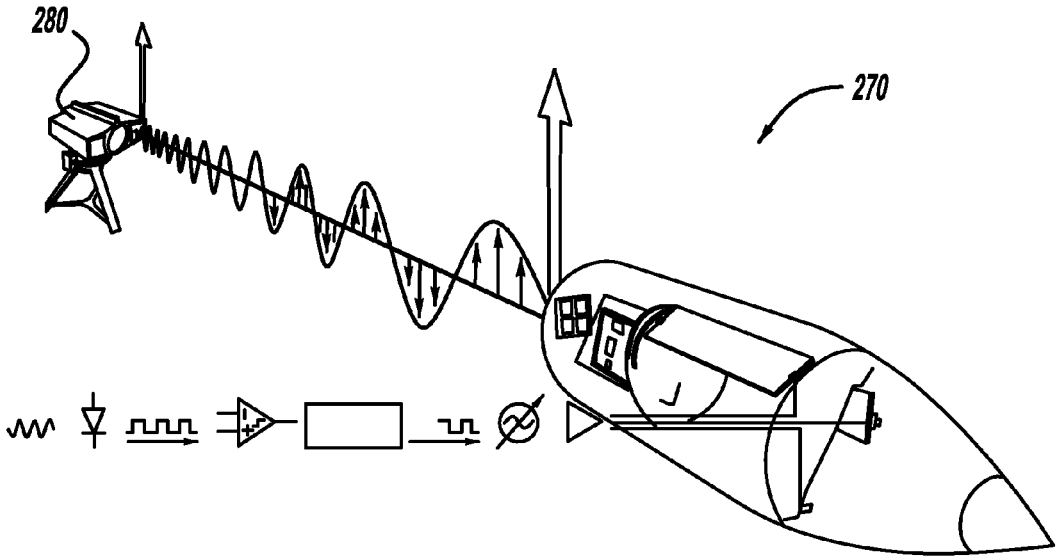
FIG. 15 is an illustration of a bullet being guided by a radar signal with a radar unit that is not attached to the rifle.

FIG. 15 also depicts another embodiment of a guidance system 270 of the present invention where an optical sighting system and radar tracking/communication system 28 is not integrated into the rifle 20, but is separate.

Another important circuit in the bullet electronics module is one that latches the integrated 3F supercapacitor power supply into the power-on state. This circuit conditions on a voltage impulse from a piezo sensor when the projectile is fired. After power-on, the microcontroller manages energy distribution. In the off state, the supercapacitor is electrically floating and the only energy dissipation is from internal leakage, which can be less than 5 μA.

Figure 16:
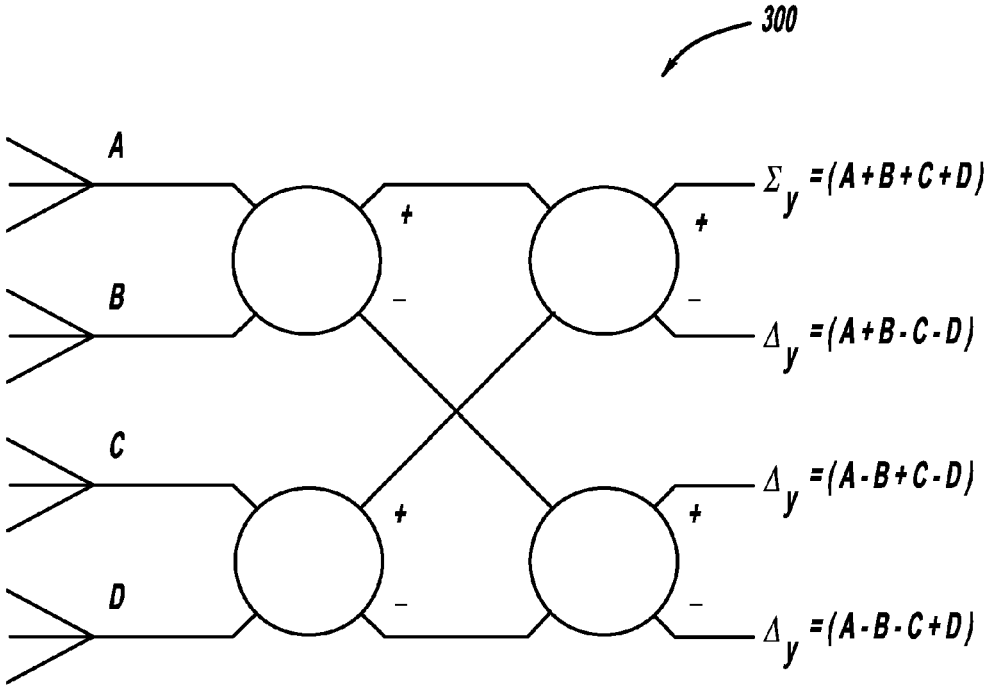
FIG. 16 is a schematic diagram of a classic four-aperture monopulse system.

FIG. 16 is an illustration of an implementation of a four-aperture monopulse structure 300. The use of a passive monopulse radar with a beacon is a highly favorable topology considering the extreme range, acute accuracy, harsh environmental conditions, the expected man-portability and reliability requirements of the system. Monopulse radar is a high-resolution method of determining a point-like target's angular position with only a single RF pulse, and is capable of providing much higher angular resolution than scanning methods while maintaining a substantially lower data rate. The basic principle of monopulse radar systems is that the similarities and differences between the signals received at distinct antennas are strong functions of the impinging wave's direction of arrival (DOA). More particularly, the sectoral DOA of a single point source can be uniquely determined by the sum of two signals (Σ-channel) and a difference of those signals (Δ-channel).

Phase-sensing monopulse operates on a similar principle. A phase-sensing monopulse uses several antennas whose radiation patterns are as closely matched as possible and the phase difference between the received signals determines the DOA. Since the antennas are distributed in space, obliquely impinging waves arrive at each antenna with different time delays, and therefore different phase delays. The DOA is found by measuring the phase progression between antenna channels. Phase monopulse is the preferred embodiment for this effort as it offers greatest sensitivity for least radar hardware complexity.

Beacon monopulse is the passive radar implementation of monopulse in which the target emits a beacon signal that is detected by the radar. It eliminates the statistical nature of the radar cross-section from the tracking equation, it mitigates against multi-path, it reduces the power required by the radar since the radar is not active, and it inhibits detection since a strong RF emission is not required to track the bullet. In beacon-mode, the design variables that given the SNR at the radar receiver are the beacon power $P_t$ and the compressed-pulse integration time $N_{\tau C}$, where N is the number of coherently summed pulses and $\tau_C$ is the pulse compression time. Higher pulse compression ratios or more coherent averages can be used to increase the SNR of the link, particularly at greater ranges where maintaining accuracy becomes more difficult. Angular resolution as a fraction of the antenna beamwidth is inversely proportional to the square root of the SNR.

Figure 17:
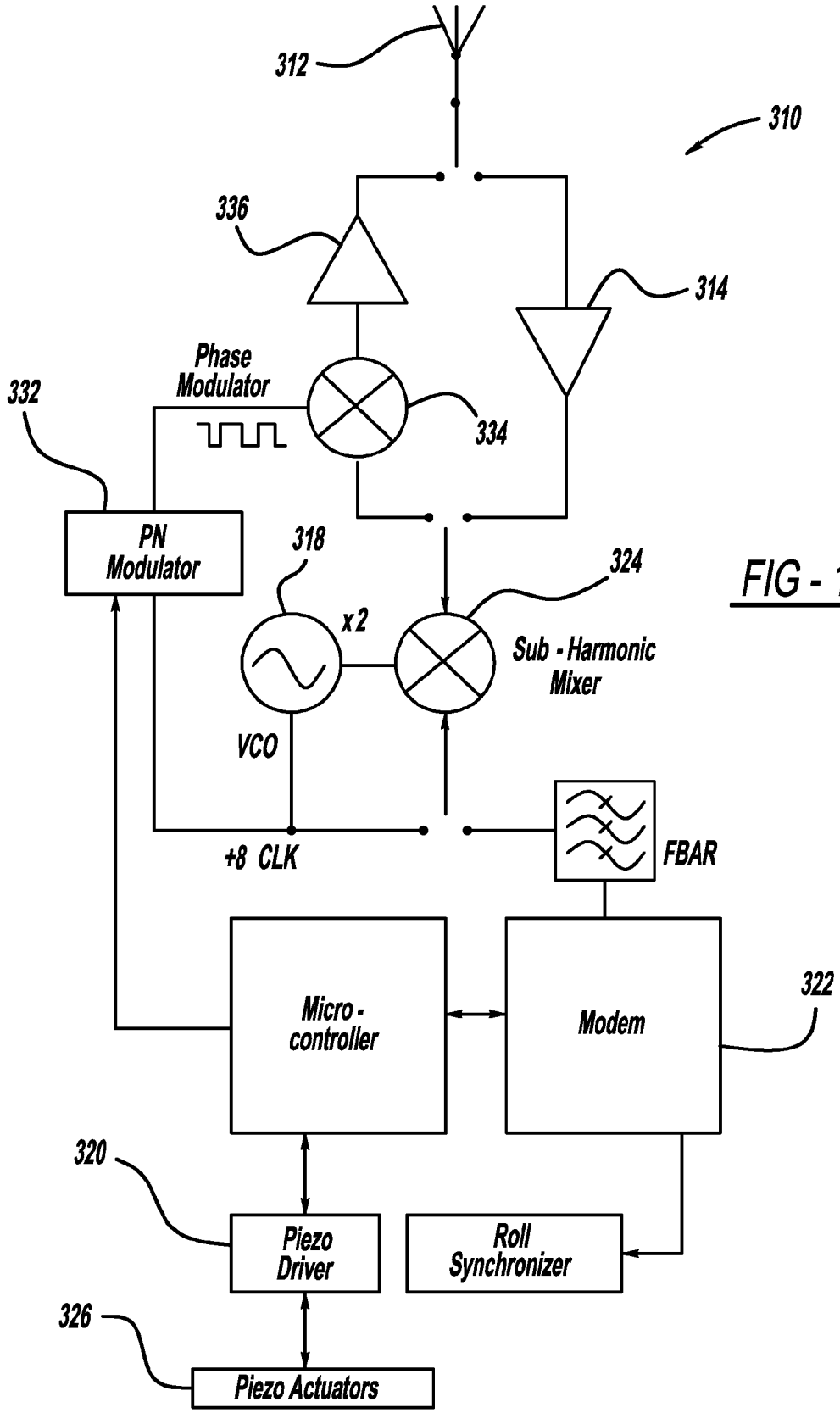
FIG. 17 is a block diagram showing RF and control eledctronics in a guided bullet.

FIG. 17 is a block diagram showing RF and control electronics 310 in a guided bullet. The RF front-end is comprised of an antenna 312, a transmit amplifier 336 and a receive amplifier 314, and is a miniaturized T/R module with a 1 GHz PN modulator 332 integrated into the transmit path and receiving PN coded data. The values of the PN code are written to an encoder buffer by a microcontroller 320 thereby PN coding the beacon. A VCO 318 provides the LO for a mixer 324 and in transmit mode this same output provides the IF for a mixer 334. When the T/R module switches to the receive operation, the RF signals are down-converted, filtered and delivered to a modem 322. Demodulated data from the radar tracker will be decoded by the microcontroller 320 and the commands parsed into action within the bullet system. The microcontroller 320 handles communication data, drives actuators 326, provides PN data, and controls the power state of all electronics in the projectile. The entire system can be powered by a supercapacitor or a battery of suitable size and capacity.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A guidance system for guiding a bullet to a target after it is fired from a gun, said guidance system comprising:

a radar unit including a plurality of receiver arrays, said receiver arrays emitting radar signals to the bullet and receiving position signals from the bullet;

an optical scope mounted to the gun for optically sighting the target;

an inertial measurement unit provided on the gun, said inertial measurement unit identifying a center location of each receiver array in the radar unit;

an RF transceiver on the bullet, said RF transceiver including an antenna; and at least one flight actuator on the bullet that controls the direction of the flight of the bullet, wherein the position signals from the bullet received by the radar unit identify the position of the bullet and the radar signal from the radar unit to the bullet provides flight path guidance to change the trajectory of the bullet in response to its position so that the at least one flight actuator directs the bullet towards the target.

2. The system according to claim 1 wherein the inertial measurement unit references the center of the array with respect to the target after it has been optically sighted and wherein the radar unit controls the flight of the bullet using the difference between the position of the bullet relative and the center of the receiver arrays.

3. The system according to claim 1 wherein the position signals from the bullet include signal polarizations that identify the roll of the bullet where the roll of the bullet is determined by comparing amplitudes of polarizations referenced to a linear polarization of a receiver on the bullet.

4. The system according to claim 3 wherein the radar unit calculates flight corrections of the bullet using the roll of the bullet and the position of the bullet.

5. The system according to claim 1 where the radar unit employs sum and difference monopulse tracking to locate the projectile and compute course corrections that control the flight of the bullet.

6. The system according to claim 1 wherein the signals transmitted between the gun and the bullet are encoded.

7. The system according to claim 6 where the encoding is chosen so that a line-of-sight signal and delayed reflected signal have low correlation.

8. The system according to claim 1 further comprising a switch on the gun that activates the inertial measurement unit to track relative motion between the target and the radar before the bullet is fired from the gun and after the target has been acquired.

9. The system according to claim 8 wherein the switch is on a grip of the gun.

10. The system according to claim 8 wherein the switch is provided by a half trigger pull of a trigger on the gun.

11. The system according to claim 1 wherein the radar unit is mounted to the gun.

12. The system according to claim 1 wherein the radar unit is separate from the gun.

13. The system according to claim 1 wherein the bullet includes a fusible switch that causes power to be provided to circuitry on the bullet after it is fired.

14. The system according to claim 1 wherein the bullet is a .50 caliber bullet.

15. The system according to claim 1 wherein the plurality of receiver arrays is two arrays.

16. The system according to claim 1 wherein the plurality of receiver arrays is four arrays.

17. The system according to claim 1 wherein the at least one flight actuator is a plurality of flight actuators that control the trajectory of the bullet.

18. A guidance system for guiding a bullet to a target after it is fired from a gun, said guidance system comprising:

a radar unit mounted to the gun, said radar unit including a plurality of receiver arrays, said receiver arrays emitting radar signals to the bullet and receiving position signals from the bullet;

an optical scope mounted to the gun for optically sighting the target;

an inertial measurement unit provided on the gun, said inertial measurement unit tracking the motion of the center location of each receiver array in the radar unit, wherein the inertial measurement unit corrects for motion between the center of the receiver arrays and the target after it has been optically sighted;

an RF transceiver on the bullet, said RF transceiver including an antenna, wherein the position signals from the bullet include signal polarizations that identify the roll of the bullet where the roll of the bullet is determined by comparing amplitudes of polarizations referenced to a linear polarization of a receiver on the bullet; and at least one flight actuator on the bullet that controls the direction of the flight of the bullet, wherein the position signals from the bullet received by the radar unit identify the position of the bullet and the radar signal from the radar unit to the bullet provides flight path guidance to change the trajectory of the bullet in response to its position so that the at least one flight actuator directs the bullet towards the target and wherein the radar unit controls the flight of the bullet using the difference between the position of the bullet relative to the center of the receiver arrays, said radar unit calculating flight corrections of the bullet using the roll of the bullet and the position of the bullet and said radar unit employing monopulse radar tracking to compute trajectory information to be sent to the bullet.

19. The system according to claim 18 wherein the signals transmitted between the gun and the bullet are encoded.

20. The system according to claim 19 where the encoding is chosen so that a line-of-sight signal and delayed reflected signal have low correlation.

21. The system according to claim 18 further comprising a switch on the gun that activates the inertial measurement unit to lock onto the target before the bullet is fired from the gun.

22. The system according to claim 18 wherein the bullet includes a fusible switch that causes power to be provided to circuitry on the bullet after it is fired.

23. The system according to claim 18 wherein the bullet is a .50 caliber bullet.

24. A guidance system for guiding a projectile to a target, said guidance system comprising:

a radar unit including a plurality of receiver arrays, said receiver arrays emitting radar signals to the projectile and receiving position signals from the projectile;

an inertial measurement unit identifying a center location of each receiver array in the radar unit;

an RF transceiver on the projectile, said RF transceiver including an antenna; and at least one flight actuator on the projectile that controls the direction of the flight of the projectile, wherein the position signals from the projectile received by the radar unit identify the position of the projectile and the radar signal from the radar unit to the projectile provides flight path guidance to change the trajectory of the projectile in response to its position so that the at least one flight actuator directs the projectile towards the target.

* * * * *